US008322663B2

(12) United States Patent
Bosik

(10) Patent No.: US 8,322,663 B2
(45) Date of Patent: Dec. 4, 2012

(54) BAG HOLDER

(76) Inventor: Anthony Bosik, Greely (CA)

( * ) Notice: Subject to any disclaimer, the term of this patent is extended or adjusted under 35 U.S.C. 154(b) by 325 days.

(21) Appl. No.: 12/730,169

(22) Filed: Mar. 23, 2010

(65) Prior Publication Data

US 2010/0252693 A1 Oct. 7, 2010

(51) Int. Cl.
*B65B 67/04* (2006.01)

(52) U.S. Cl. ..... 248/97; 248/99

(58) Field of Classification Search ..... 248/95, 248/97, 99, 100, 101
See application file for complete search history.

(56) References Cited

U.S. PATENT DOCUMENTS 1,018,228 A * 2/1912 Appleby et al. ..... 248/97
1,653,393 A 12/1927 Cox
3,603,541 A * 9/1971 Sturm et al. ..... 248/97
3,905,406 A * 9/1975 Cruse ..... 141/390
4,664,348 A * 5/1987 Corsaut et al. ..... 248/99
4,783,031 A 11/1988 Ebentheuer
5,060,893 A * 10/1991 Halbert ..... 248/97
5,460,343 A * 10/1995 Hestilow ..... 248/124.1
6,481,591 B2 * 11/2002 Mendoza et al. ..... 220/9.2
8,020,686 B2 * 9/2011 Babineau et al. ..... 193/2 R
2011/0284703 A1 * 11/2011 Auguste ..... 248/99

* cited by examiner

*Primary Examiner* — Ramon Ramirez
(74) *Attorney, Agent, or Firm* — Ronald G. Bitner

(57) ABSTRACT

A bag holder adapted to fit inside a flexible bag to support the bag comprising a rectangular frame having four vertical legs connected to and depending from the frame. Each of the legs has an inwardly bent portion at the lower end thereof to facilitate sliding entry into the bag. The legs are flexible such that upon pushing down on the frame the bend portion provides that the legs bow outwardly against the inside of the bag, shaping the bag into an unwrinkled and more rigid and stable state. With the frame reacting against the bag, the frame can resist a greater downwards vertical load which assists in the filling of the bag.

1 Claim, 1 Drawing Sheet

BAG HOLDER

BACKGROUND OF THE INVENTION

1. Field of the Invention

This invention relates to a holder for bags, and particularly to a holder for bags such as leaves, garden waste, or trash.

2. Description of the Prior Art

Various forms of holders have been proposed for holding open a bag to facilitate filling. Somewhat similar bag holders are disclosed in U.S. Pat. Nos. 1,653,393 3,905,406 and 4,783,031 in that they include a rectangular frame and four depending legs. However, such bags have been found not to be entirely satisfactory in terms of ease of insertion into the bag and moreover do not provide for shaping of the bag to improve rigidity, as does the present invention.

SUMMARY OF THE INVENTION

An object of the present invention is to provide a simple and improved bag holder.

A specific object of the invention is to provide a bag holder of simple construction that facilitates inserting the holder into the bag and allows straightening and shaping of the bag to form a more rigid and stable structure.

It has been found that an improved bag holder can be provided with a simple structure comprising a rectangular frame having four vertical flexible legs and wherein each of the legs has an inward bend near the lower end thereof.

Specifically, the present target comprises a bag holder adapted to fit inside a flexible bag to support the bag, comprising a rectangular frame having four vertical legs connected to and depending from the frame; each of the legs having an inwardly bent portion at the lower end thereof to facilitate sliding entry into the bag; the legs being flexible such that upon pushing down on the frame the bent portion provides that the legs bow outwardly against the inside of the bag, shaping the bag into a less wrinkled and more rigid and stable state.

DESCRIPTION OF THE PREFERRED EMBODIMENTS

Figure 2:
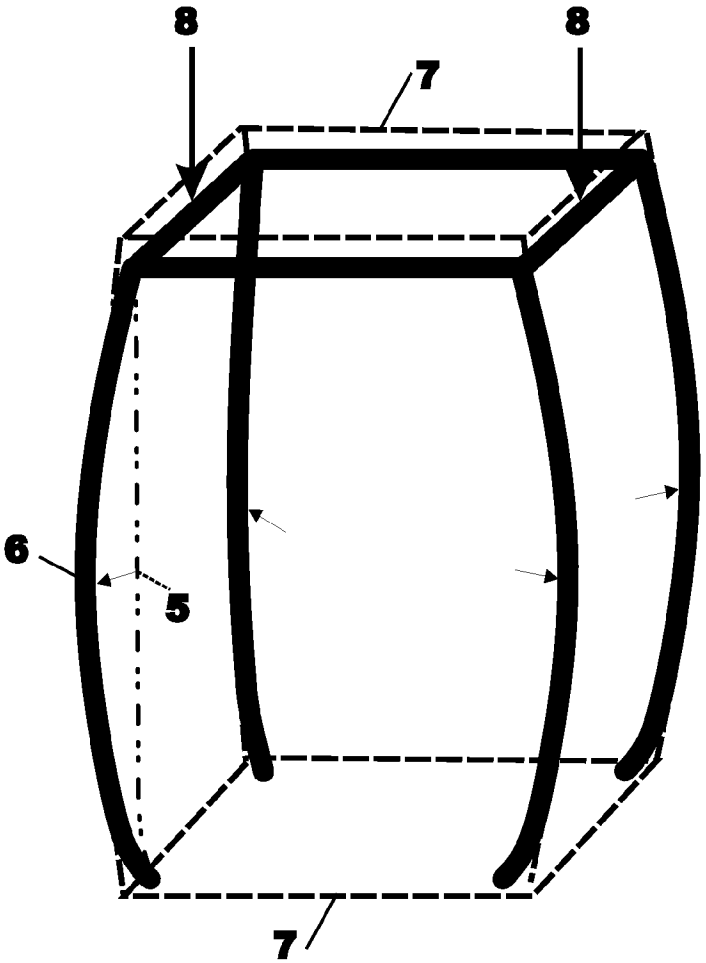
FIG. 2 is a perspective view of the bag holder as shown in FIG. 1 placed in a bag and showing the effect of pushing down on the holder.
Figure 1:
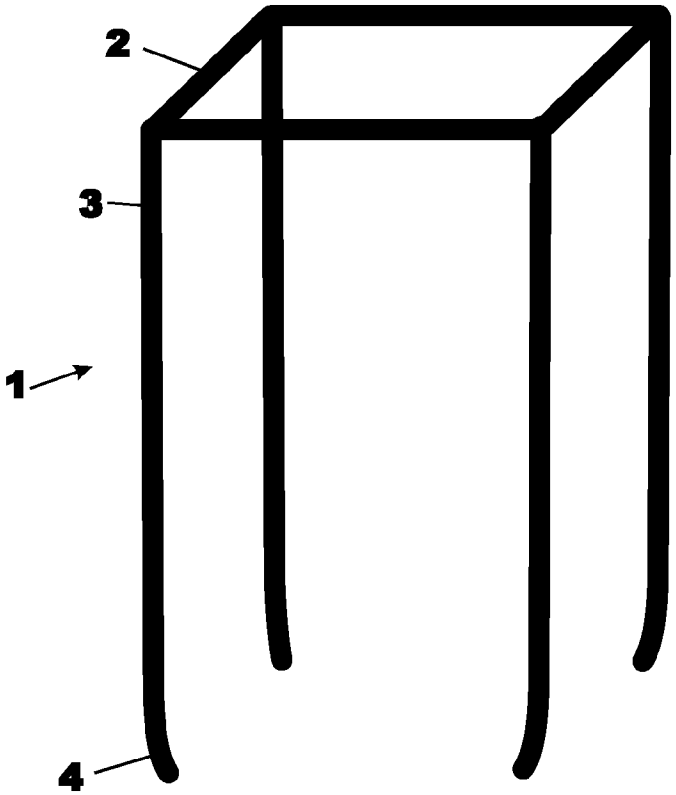
FIG. 1 is a perspective view of one embodiment of the bag holder according to the present invention.

With reference to FIGS. 1 and 2, the bag holder 1 of the present invention comprises a rectangular frame 2 having four vertical legs 3 connected to and depending from the frame 2. The bag holder is adapted to fit inside a flexible trash bag to hold it open and support it for filling. Each leg has an inwardly directed bent portion 4 at the lower end thereof. The bent portions 4 are bent inwardly toward a central axis parallel to the vertical longitudinal axes of the 4 legs. The bent portions provide a curved surface that act as runners to facilitate sliding entry into the bag.

Another function of the bent portions 4 is to facilitate shaping of the bag to improve its rigidity and stability. This is made possible by having legs 3 that are flexible, allowing them to bow outwardly against the wall of the bag, initiated by the bend 4, when the leg is compressed, as shown in FIG. 2, and detailed below.

A typical bag for garden waste is made of paper and is supplied in folded form. Simply inserting the bag holder into the bag does not normally leave the bag in a neat unwrinkled state. With the present invention, the legs 3 are flexible such that upon pushing down on the frame 2, such as at 8, the inward bend 4 provides that the legs bow outwardly against the inside wall of the bag 7, placing the bag wall in tension, thus creating a combined stable and strong bag/frame system. As shown in FIG. 2, the legs bow outward to the position shown at 6, deviating from the original position shown at 5. The outward bowing of the legs against the inside of the wall straightens and shapes the walls of the bag 7 into a more flattened and unwrinkled state. The smoothened unwrinkled walls and corners provide for a more rigid and stable structure for the bag 7.

As indicated above, to achieve the desired bowing out effect, the bent portion 4 is located at the lower end of each leg. The flexibility of the legs should be such as to provide the desired bowing upon providing a reasonable downward force on the frame 1, while maintaining sufficient rigidity of the frame leg structure to adequately support the bag while filling. Suitable results in terms of ease of insertion and providing the desired bowing upon compression appear to be obtainable with the bend in the lower 5 to 20% region of the leg.

In operation, the bag holder is inserted into a bag facilitated by the bent/curved ends which readily slide along the inside corners or walls of the bag to the bottom of the bag. When inserted into the bag, the holder supports the bag in an open condition for filling. To shape the bag, the holder is pushed down, using the frame portion. When pushed down, the bent portion causes the flexible legs to bow outward applying tension to the walls of the bag. This action straightens the walls, removing wrinkles, and improves the rigidity and stability of the bag. This feature assists while filling the bag since the frame can resist a greater amount of vertical load because the frame reacts against the bag.

While the present bag holder is particularly suited for paper garden bags, it can be seen that it can also be useful for other types of bag. It will be understood that the holder can be made of various dimensions, depending on the size of the bag it is to be used for.

What is claimed is:

1. A bag holder adapted to fit inside a flexible bag to support said bag, said holder comprising:

a rectangular frame having four vertical legs connected to and depending from said frame;

each of said legs having an inwardly bent portion at the lower end in the lower 5 to 20% region thereof to facilitate sliding entry into the bag;

said legs having flexibility such that upon pushing down on the frame the bent portion provides that the legs bow outwardly against the inside of the bag, shaping the bag into a less wrinkled and more rigid and stable state.

* * * * *